US010076204B1

(12) United States Patent
Sadeghi

(10) Patent No.: US 10,076,204 B1
(45) Date of Patent: Sep. 18, 2018

(54) PARCEL GUARD WITH EXPANDABLE MESH BASKET RECEPTACLE

(71) Applicant: Mohsen Esmail Sadeghi, Richardson, TX (US)

(72) Inventor: Mohsen Esmail Sadeghi, Richardson, TX (US)

( * ) Notice: Subject to any disclaimer, the term of this patent is extended or adjusted under 35 U.S.C. 154(b) by 0 days.

(21) Appl. No.: 15/866,133

(22) Filed: Jan. 9, 2018

(51) Int. Cl.
*A47G 29/20* (2006.01)

(52) U.S. Cl.
CPC ..... *A47G 29/20* (2013.01)

(58) Field of Classification Search
CPC .. A47G 29/12; A47G 29/1223; A47G 29/124; A47G 29/20; A47G 2029/144
USPC ..... 232/19, 44, 45
See application file for complete search history.

(56) References Cited

U.S. PATENT DOCUMENTS 1,797,961 A * 3/1931 McBride ..... B65D 29/00 232/19
2,710,732 A * 6/1955 Peters ..... A47G 25/54 248/100
2,829,820 A * 4/1958 Evers ..... A47G 29/1223 232/19
3,802,620 A * 4/1974 Ferrara ..... A47G 29/12 232/19
4,069,965 A * 1/1978 Maddox, Jr. ..... A47G 29/1223 232/19
4,776,512 A * 10/1988 Moore, Sr. ..... A47G 29/1223 232/19
5,368,226 A * 11/1994 Franceschino ..... A47G 29/1223 232/19
5,492,272 A * 2/1996 Fewer ..... A47G 29/12 232/19
7,240,823 B1 * 7/2007 Saidiazar ..... A47G 29/12 232/19
7,318,548 B2 * 1/2008 Felice ..... A47G 29/1207 232/19
2002/0070269 A1 * 6/2002 Rosiello ..... A47G 29/12 232/19
2006/0065705 A1 * 3/2006 Plappert ..... A47G 29/12 232/19
2009/0184159 A1 * 7/2009 Crawford ..... A47G 29/12 232/19

* cited by examiner

*Primary Examiner* — William L Miller

(57) ABSTRACT

A parcel guard with expandable mesh basket receptacle is a safeguard mechanism for receiving and keeping packages comprising of a scalable, flexible, collapsible net basket made of wire mesh, metallic chain links, composite material or any combination of material suitable to create a shaped net basket and a means of locking mechanism to deter theft temptation. The flexible net basket of this apparatus allows parcels of various size, shape and weight to be placed inside the net basket and securely locked away as part of a theft prevention mechanism that prevents unauthorized removal of the parcels.

8 Claims, 7 Drawing Sheets

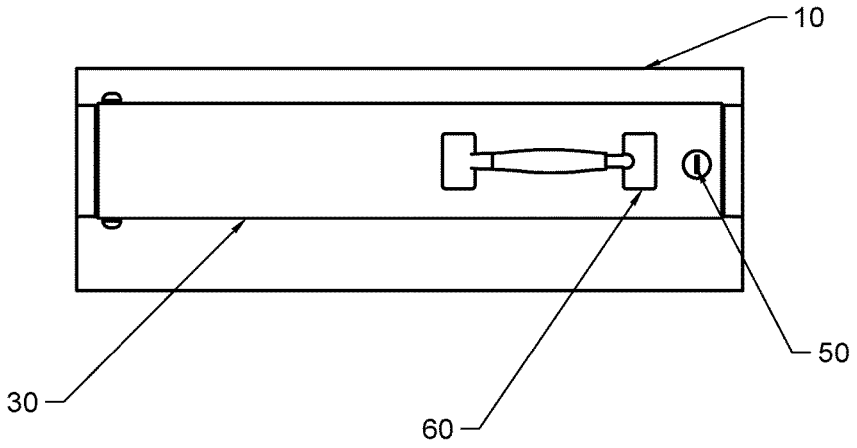
FIG. 2
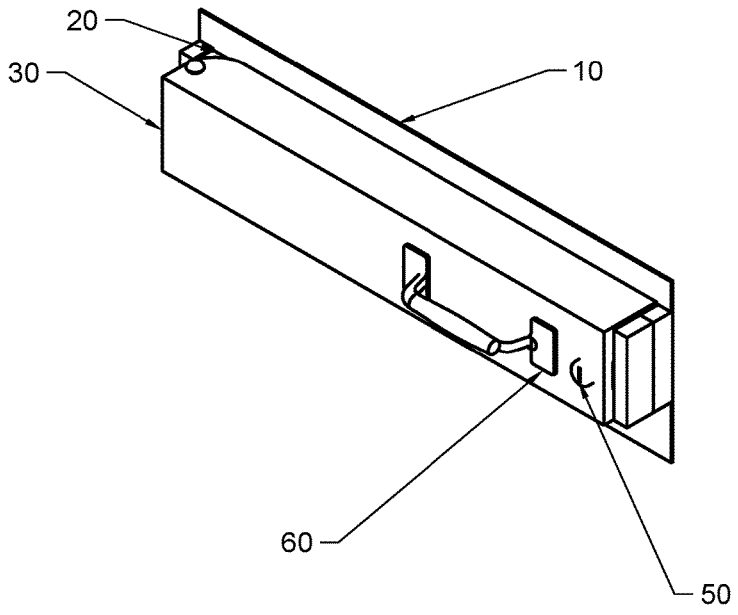
FIG. 2.1

PARCEL GUARD WITH EXPANDABLE MESH BASKET RECEPTACLE

BACKGROUND OF THE INVENTION

Field of the Invention

The current invention relates to apparatus to provide the secure delivery of packages, parcels or mail to residential household, business premises. More specifically, the invention relates to safeguarding unattended delivered parcels utilizing wire mesh basket to enclose packages in a theft-proof manner to be retrieved by an authorized person at a later time.

Background Art

Ecommerce and internet have evolved the way consumers making their purchases online. Along with this growth in internet trade and online purchase of goods, there has been an increase in the delivery of goods to the households and businesses. Since most ordered products comes in packages that are usually too big to fit through standard mailbox, to ensure safe receipt of the ordered goods the customer is required either to be at home at the time of delivery, or to collect these goods from a post office or seller's storehouse, otherwise the parcels could be left unguarded in front of the intended recipient door.

There are many prior arts that are designed to solve this common problem of keeping packages of various sizes safe until the intended authorized receiver retrieves it.

There are known parcel boxes with different types and size enclosure and of locking mechanisms for secure delivery of parcels (Antitheft mailbox U.S. Pat. No. 7,252,220 B1, "A mailbox comprising side and back walls, a top and a bottom secured together to form an enclosure, a front access door mounted to the front wall, a rear access door connected to the rear access door, and a tray accessible through the front access door and vertically adjustable").

There are known theft-resistant receptacle boxes having pre-defined shape and size referenced by the prior arts: (Theft-resistant wall mount mailbox U.S. Pat. No. 9,717,359B2, "A theft-resistant wall mount mailbox is provided. A housing has a rectangular shape with a front side and a back side. A rotatable mail deposit is pivotally attached to the front side of the housing and includes a mail delivery door, an inner panel affixed on a proximate end at an angle to a bottom of the mail delivery door, and a safety arm affixed at a further angle to a distal end of the inner panel. A mail retrieval door is located below the rotatable mail deposit and pivotally attached to the front side of the housing").

There is a known parcel box (U.S. Pat. No. 7,320,427B2, "The present invention is a security mailbox utilizing a combination package rest and security panel. A mail slot in the security panel prevents easy access to contents of the mailbox. The present invention may be utilized in situations other than mail delivery where security for contents is desired").

There is known secured mailbox (U.S. Pat. No. 3,880,344A "A secured mailbox for receiving mail of different character and comprising: a vertical throat of horizontal cross section defined by back, front and side walls; a lower receptacle into which said throat opens and having an access door secured by a lock; a door pivotally mounted on a horizontal axis to the upper edge of said front wall and providing upper and lower rectangular panels of substantially the same size and shape, said lower door panel corresponding in size and shape to the cross sectional area of said throat, said back and side walls extending above the top edge of said front wall a distance substantially equal to the height of the upper door panel when the latter is in vertical position; a rectangular top wall secured to the upper edges of said side and back walls and having a length substantially twice the corresponding dimension of the throat; the top edge of the front wall, the side walls above the top edge of the front wall and the undersurface of said top wall defining an opening which is normally closed by the upper door panel when the latter is in vertical position and through which mail is passed when the upper door panel is in a horizontal position; and, a door stop extending horizontally outwardly from the upper edge of said front wall").

One of the most obvious problems these prior arts have in common is the concept of having a rigid confined box type receptacle with variety of predefined enclosure walls dimensions to hold the parcels. Since the size or shapes of the receiving parcels are unknown in most cases, these prior arts designs for receiving packages are limited to the provided enclosure rigid box. The larger the parcel get the bigger the rigid box has to get to accommodate it, therefore manufactures have to design and build larger sized mailboxes to allow safekeeping of randomly sized delivered parcels. As a result, these rigid boxes turn out to be bulky, heavy, and expensive that occupies a great deal of space.

Therefore there is a need for a parcel receiver apparatus that on one part having means of being scalable to different parcel sizes, flexible to allow all package shapes and collapsible to decrease it's occupying space in absence of any package presence and on the other part having means of safeguarding the package. The solution is the current invention that comprises of a scalable, flexible, collapsible mesh basket receptacle with means of locking mechanism to provide a safekeeping of packages until it is retrieved by an authorized intended receiver.

Flexible mesh basket will allow sufficient dynamically adjustable capacity to even hold large-size articles with ease while having means preventing unauthorized removal of articles delivered in absence of addressee.

SUMMARY OF THE INVENTION

In view of the foregoing disadvantages inherent in the known types of mailbox and secure parcel receptacle system which holds the parcels secure in the prior art, the present invention provides a new approach to safeguard the parcels wherein the parcels could be of any size, shape or weight while occupying the lesser of outside space.

The general purpose of the present invention, which will be described subsequently in greater detail, is to provide a new solution safeguarding unattended delivered packages from being taken away by unauthorized individuals. The apparatus and method which has many of the advantages of secure mailboxes of prior arts mentioned heretofore and many novel features that result in a new Parcel guard with expandable mesh basket receptacle which is not anticipated, rendered obvious, suggested, or even implied by any of the prior art mailbox system which provides safe keeping of parcels, either alone or in any combination thereof.

To attain this, the present invention generally comprises of a scalable, flexible, collapsible basket made of wire mesh, metallic chain links, composite material or any combination of material suitable to create a shaped mesh basket and a means of locking mechanism to deter theft temptation.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Such variation in design could include an embodiment where there is no retracting mechanism to force the said mesh basket to collapse and retrieved to it's at rest position. Furthermore the embodiments are not limited to one particular industry such as residential or commercial mailbox receptacles; they could be easily applied to other industries such as automotive. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new parcel guard apparatus and method which has many of the advantages of the secure mailbox system which safeguards the parcels heretofore and many novel features that result in a parcel guard with expandable mesh basket receptacle which is not anticipated, rendered obvious, suggested, or even implied by any of the prior art secure mailbox system which offers safe keeping of the parcels, either alone or in any combination thereof.

One or more embodiments of the present invention provides a parcel safeguard with wire mesh basket for receiving and keeping parcels of many sizes or shapes in a theft-proof manner.

According to one or more embodiments of the present invention, a parcel safeguard comprises sufficient scalable, flexible, collapsible capacity confinement basket to be able to receive variety of size, shape, weight articles, means preventing unauthorized removal of packages delivered in absence of its intended receiver, simple to use, inexpensive, safeguard reliable and easy-to-install.

According to one or more embodiments of the present invention, a parcel guard with expandable mesh basket receptacle comprises a base platform panel to be mounted on any variation of XYZ axis surfaces which can be secured to the surface by any means of screws, nails, adhesives, welds, hooks, magnets, straps, ties or any combination and or methods of securing or bonding two surfaces together. The base platform would have the means of shaped groves, notches and housing members for secure attachment and the support of other assembled parts.

The means for removable inner lever with means of one end securely placed inside a housing as part of base platform and second end situated on the opposite side with means of engaging and disengaging mechanism from the base platform by any means of latch, screws, ties, magnets or any combination of electrical or mechanical means suitable to secure the inner lever to the base platform. The said inner lever would have the means of hinged or pin mechanism on one end opposite from the disengaged mechanism to the base platform to allow for pivotal means of connecting and supporting the outer lever member.

The outer lever member would have the means having one end being pivotally connected alongside the length of the inner lever and having the second end on the opposite side equipped with means of secure locking mechanism to the base platform housing. The said outer lever would have the means of securely being connected to the mesh net basket.

The basket comprises the means of scalable, flexible, collapsible and retractable means of providing a secure parcel confinement enclosure to prevent package removal by an unauthorized person made of any and all type of materials and their combinations suitable to form a basket. The preferred said basket would have the means when there is no packages inside to retrieve to its at rest position in order to minimize occupying space, the makeup composition materials of the said basket are of wires, chain links, cables, reinforced fabrics, Kevlar, composite materials or any combined combination of materials that are commercially available.

BRIEF DESCRIPTION OF THE DRAWINGS

FIG. 2 illustrates a front view of the parcel guard with expandable mesh basket receptacle;

FIG. 2.1 illustrates a front south-west view of the parcel guard with expandable mesh basket receptacle;

DESCRIPTION OF THE PREFERRED EMBODIMENTS

Hereafter, an embodiment of the invention will be described. In embodiment of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

Figure 1:
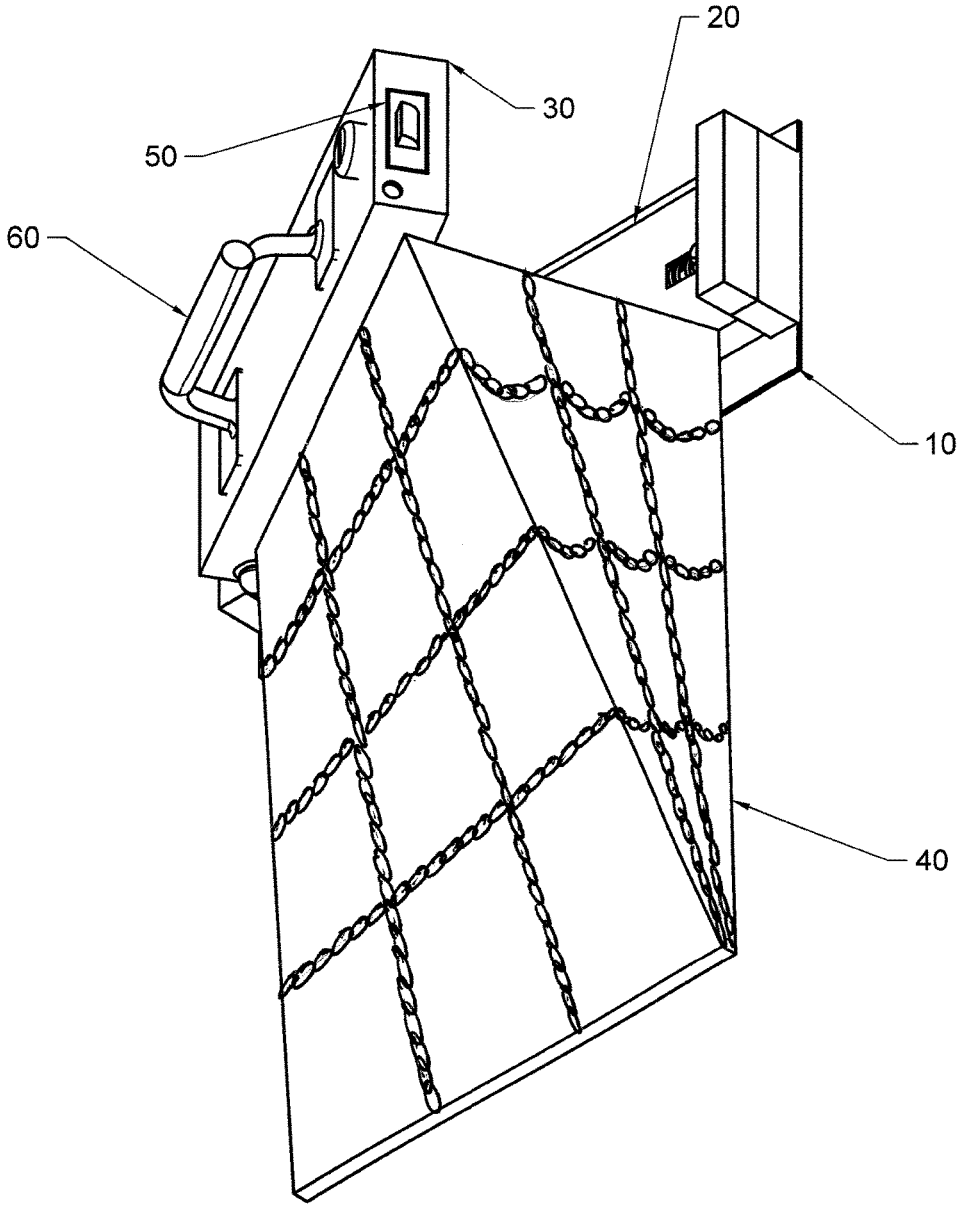
FIG. 1 illustrates a front north-west view of the parcel guard with expandable mesh basket receptacle, the present invention.

Referring now to the drawings, in FIG. 1, the apparatus of the invention comprises a base platform plate, denoted generally by reference numeral 10, a detachable inner lever denoted generally by reference numeral 20, an outer arm denoted generally by reference numeral 30, a mesh basket denoted generally by reference numeral 40 a means of locking mechanism denoted generally by reference numeral 50, a handle mounted on outer arm denoted generally by reference numeral 60.

Referring now to the FIG. 2 and FIG. 2.1 drawings, this front and south-west view of the preferred embodiment respectfully provides a more visible 3-dimensional view of the invention whereas the mesh basket is at it's rest position and not visible.

Figure 3:
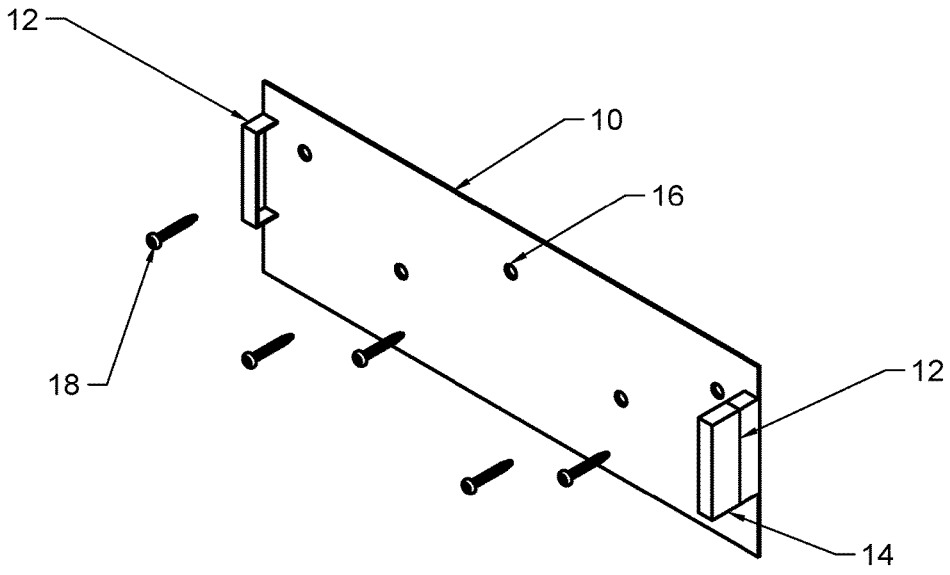
FIG. 3 illustrates an exploded base platform view of the parcel guard with expandable mesh basket receptacle.

Referring now to the FIG. 3 drawing, it is disclosing the means for base platform plate denoted generally by reference numeral 10. The base platform plate would have the means of two attached housings situated opposite each other denoted generally by reference numeral 12. The attached housings on one end would have an extension generally denoted by reference numeral 14 to accommodate a securely engaged locking mechanism of reference 50. There are number of holes distant apart and on multi parallel path across the base platform plate denoted generally by reference numeral 16 to allow screws of referenced 18 or other means of fastening the base plate to other planes or objects.

The means of first housing is to secure and hold in place the one end of inner lever and the means of second housing with more design functionality on the opposite side comprises the means of providing secure latching mechanism to both inner lever and outer arm.

The base platform plate comprises the means of securely being mounted on any XYZ axis plane. The securing means could be in form of, sets of screw holes places on base platform plate in such manner to be concealed by the inner lever and screws to attach the base platform plate to mounting surface as denoted in FIG. 3 by reference numeral 16 and 18 respectfully. The concealment of the screw holes and screws are part of theft prevention means that would prevent an unauthorized person to detach the embodiment while it is in a lock position.

Other means of securing the base platform plate to any XYZ axis plane would include but not limited to the use of glues, straps, hooks, loops, nails, clamps, cables, wires, welds, magnets, sliding frames or any other conventionally used method and material for securing two surfaces together.

Figure 4:
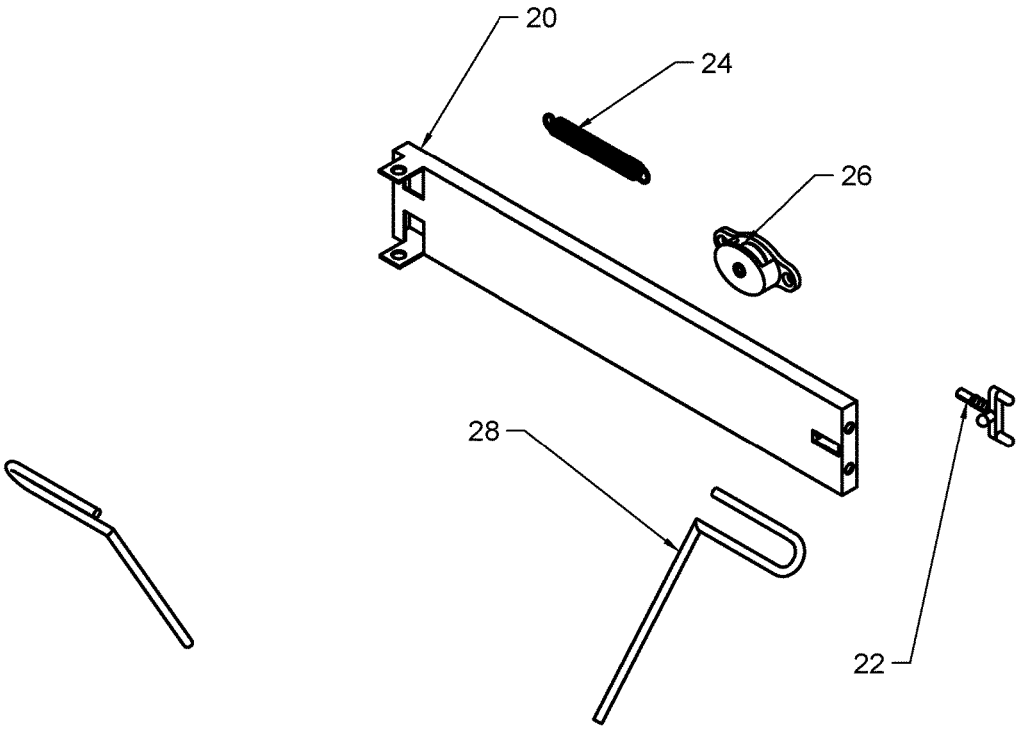
FIG. 4 illustrates an exploded view of inner lever view of the parcel guard with expandable mesh basket receptacle.

Referring now to the drawings in FIG. 4, the preferred embodiment of the invention comprises an inner lever denoted generally by numeral 20. The said inner lever, at one end would have the means to allow a range from 0 degree to 360 degree of rotational motion alongside any XYZ axis plane through the means of pin holes assembly, hinge assembly, spring assembly, ball joint assembly, universal joint assembly or any other commercially used rotational joints in which it would be inserted into one end of the base platform 10 housing.

The second end of the inner lever referenced in FIG. 4 denoted by numeral 20 oriented on opposite side to the rotational assembly feature has the means to provide latching mechanism housing to securely connect and hold in place the inner lever to the base platform plate housing.

The latching mechanism as denoted in FIG. 4 by reference numeral 22 provides the means to allow easy attach and detachment of the said inner lever from the base platform plate. The said latching mechanism comprises the means to push the latching lever bar forward into base platform housing to insure a secure engagement between the base platform plate and the inner lever or to pull back and disengage the inner lever from the base platform plate in a case it is desired to do so. The means used to push, pull the latching assembly comprises of compression spring, magnets, electromagnetic components, tape springs, rack and pinion systems, gear systems, elastic rubber, rubber loops or any conventionally used material and components to perform the task of push, pull functions.

Figure 5:
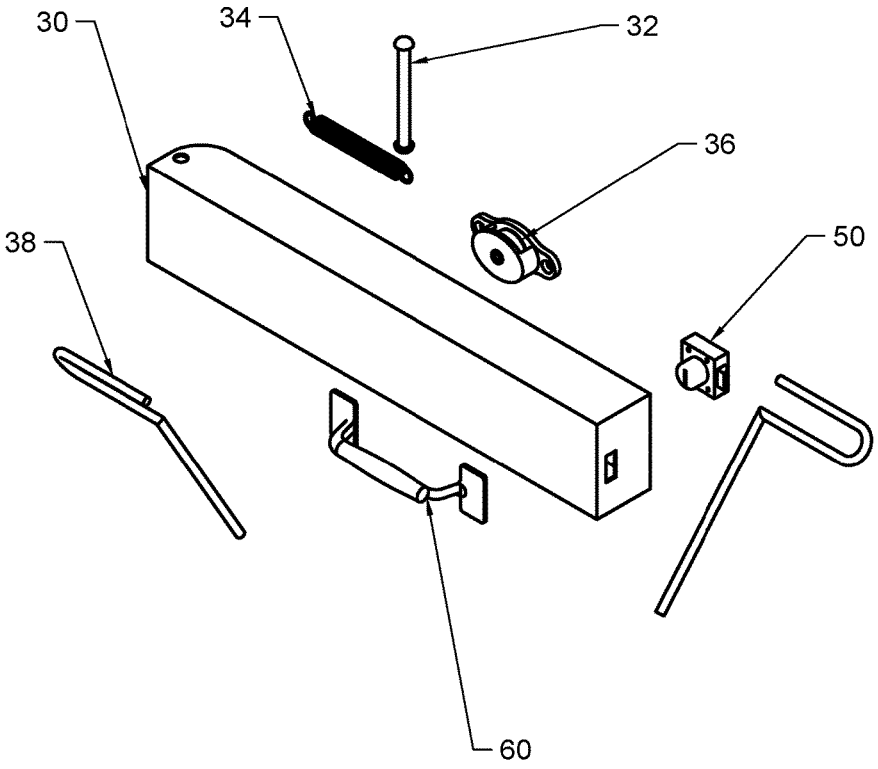
FIG. 5 illustrates an exploded view of outer arm view of the parcel guard with expandable mesh basket receptacle.
Figure 6:
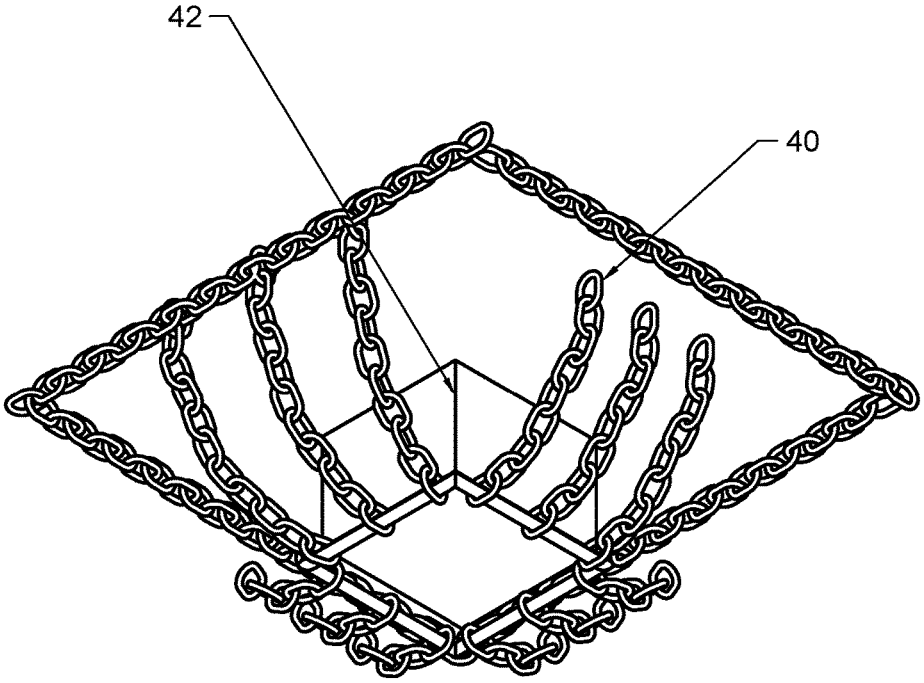
FIG. 6 illustrates the north-west view of the mesh basket of the parcel guard with expandable mesh basket receptacle.

The means of latching mechanism of referenced numeral 22 is to allow a quick disengagement of other components of the embodiment as they are being referenced in FIG. 5-6 so that the delivery placement and extraction of any larger and heavier packages would be rather more convenient, safer and secure.

The said inner lever of referenced numeral 20 of FIG. 4 could also provide a housing compartment to include other components such that is being denoted by reference numeral 24, 26 and 28 as part of retracting system of wire mesh basket of FIG. 1 referenced numeral 40.

The expansion spring of denoted by reference numeral 24 in FIG. 4, has the means of being attached from one end to the inner lever 20 and the opposite side being connected to the retracting guide cable of referenced 28 of FIG. 4.

The rotational pulley housing assembly denoted by reference numeral 26 of FIG. 4 has the means of redirecting the path of liner motion of spring 24 and retracting guide cable 28 caused by the pull forces applied due to the weight of package inside the wire mesh basket.

The retracting guide cable denoted by reference numeral 28 in FIG. 4, has the means of being connected to the spring 24 from one end and to the wire mesh basket of 40 from the opposite end.

The means of connecting components referenced by numeral 24, 26 and 28 in FIG. 4 together is to create a system that now can be referred to as retracting system in this document, allowing the wire mesh basket 40 to expand whenever there is a package inside the basket and to collapse and retrieve the wire mesh basket in times there are no package inside the basket.

Referring now to the drawings, in FIG. 5 of preferred embodiment of the current invention comprises of outer arm denoted by reference numeral 30 in FIG. 5. The said outer arm 30 has the means of being connected from one end to inner lever 20 with ability for rotational functionality at various degrees preferably in horizontal direction.

The opposite end of said outer arm 30 would have the means of housing a spring bolt lock mechanism denoted by reference numeral 50 in FIG. 5. The said spring bolt lock 50 allows the outer arm to be securely connected and locked inside the base platform plate housing 14.

The said spring bolt lock 50 has the lock-unlock capability mechanism operated by the means of keys, digital key pads, mechanical key pads, digital scanners, thumb scanner, eye scanner, user interface apps, phone apps, RF sensors, barcodes, or any other commercially available locking system including magnetic locks.

The said spring bolt locking mechanism is part of theft prevention effort that would allow the delivery person to place the package inside the wire mesh basket 40 and push the outer arm in towards the base platform plate until it latches and locks inside the base platform plate housing 14. The removal of the package from the wire mesh basket after it has been pushed close can only be achieved by an authorized person using properly designated unlocking instrument such as physical key, digital code, push button access code just to mention a few.

The connecting pin denoted by reference numeral 32 in FIG. 5 used as the means of connecting said outer arm 30 and inner lever 20 while facilitating the rational motion of the outer arm 30 alongside its axis. The means of connecting the outer arm 30 and inner lever 20 at rotational end could be made of variety of components or materials including but not limited to hinges, flat rubbers, rubber loops, fabrics, leathers, natural and synthetic elastic materials, spring of any type, gears, warm drives or any commercially available components and, or materials to allow rotations operations.

The said outer arm of referenced numeral 30 of FIG. 5 could also provide a housing compartment to include other components such that is being denoted by reference numeral 34, 36 and 38 as part of retracting system of wire mesh basket of FIG. 1 referenced numeral 40.

The expansion spring of denoted by reference numeral 34 in FIG. 5, has the means of being attached from one end to the outer arm 30 and the opposite side being connected to the retracting guide cable of referenced 38 of FIG. 5.

The rotational pulley housing assembly denoted by reference numeral 36 of FIG. 5 has the means of redirecting the path of liner motion of spring 34 and retracting guide cable 38 caused by the pull forces applied due to the weight of package inside the wire mesh basket.

The retracting guide cable denoted by reference numeral 38 in FIG. 5, has the means of being connected to the spring 34 from one end and to the wire mesh basket of 40 from the opposite end.

The means of connecting components referenced by numeral 34, 36 and 38 in FIG. 5 together is to create a system that now can be referred to as retracting system in this document, allowing the wire mesh basket 40 to expand whenever there is a package inside the basket and to collapse and retrieve the wire mesh basket in times there are no package inside the basket.

The handle denoted by reference numeral 60 in FIG. 5, is attached to outer arm by the means of providing convenience grip to push/pull the outer arm 30 pivoting alongside pin 32.

Referring now to drawings in FIG. 6 denoted by reference numeral 40 is a representation of chain links mesh basket capable of being expanded or collapsed, folded or stretched, extended or retrieved. The wire mesh basket is only one representation of said basket. The basket can be made of any material that would allow it to expand in order to accommodate the package size and weight while capable of being retrieved back to its initial position once the content package is removed. The most conveniently available material to make such said basket could be made of woven wire mesh, metal wire loops, metal wires, metal cables, composite materials, natural or synthetic fabrics, natural or synthetic lines, all petroleum base materials, all types of carbon base Nano-technology materials or any other material commercially available suitable to form a basket shape.

The said basket of drawings in FIG. 6 denoted by reference numeral 40 would have the means of being connected to the retracting guided cable of referenced numeral 28 in FIG. 4 and numeral 38 in FIG. 5. The retracting guided cables are part of retracting system comprised of springs, pulleys assembly and retracting guided cables that would allow the basket to extend and expand in volume according to size, shape or weight of the delivered package placed inside the basket and to be retracted and retrieved back to its designated at rest position and shape once the delivered package has been removed by an authorized recipient.

The means of this said basket is to provide a confined structure surrounding the delivered package that would be resilient enough against cutting, snipping, tearing or tampering with by an unauthorized person using instruments such as pocket knives or other sharp object they could be caring with them. The said basket is part of theft prevention effort to deter the will of an unauthorized person from an attempt to remove the delivered package.

The said basket in one embodiment could include the means of sensory instruments to sound an alarm, take pictures, record videos, and send text messages or other means of notifying an authorized person(s).

It is understood; the use of the retracting system of the said basket is part of this preferred embodiment and may not be included in some other embodiments.

Figure 7:
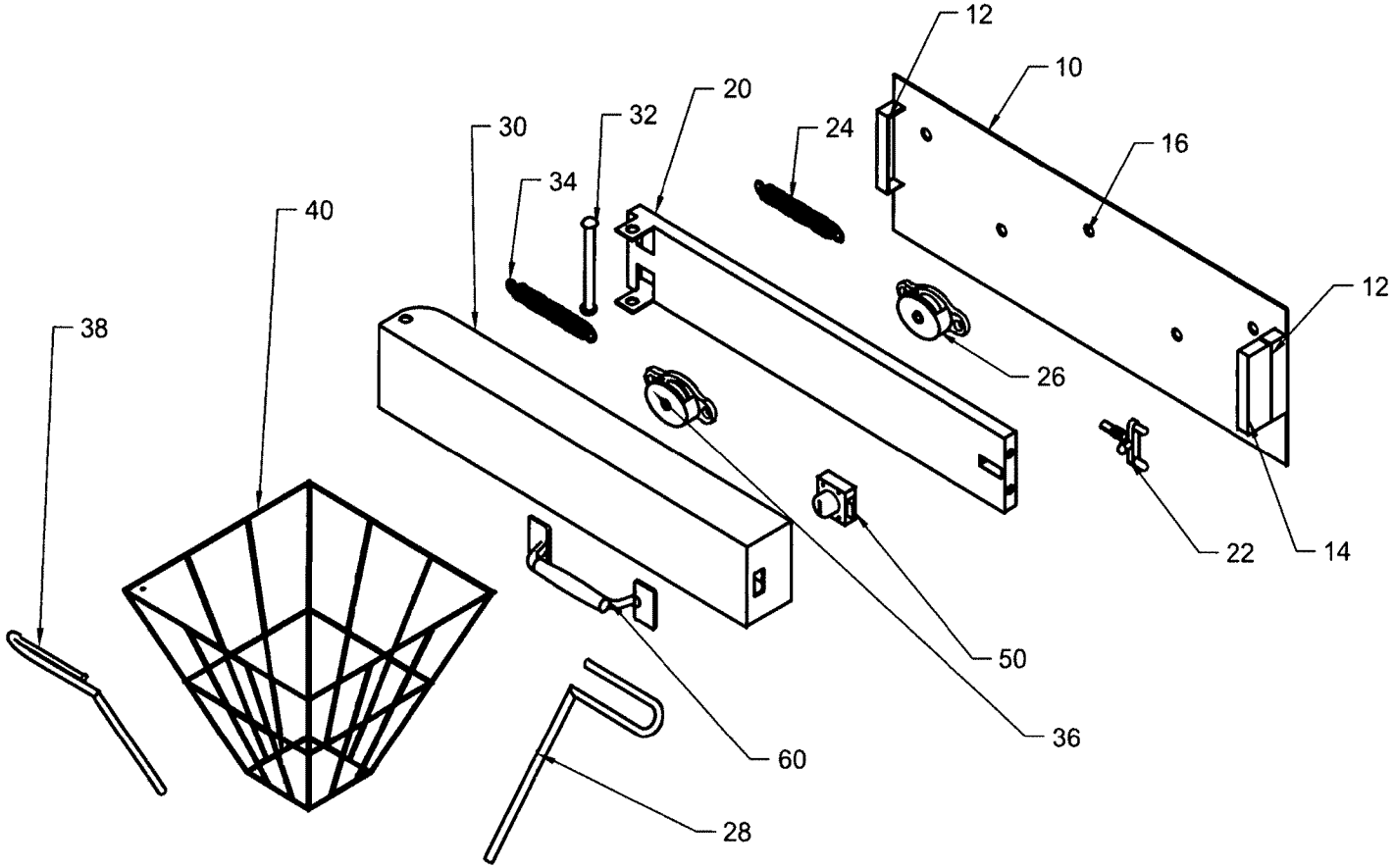
FIG. 7 illustrates the exploded view of components referencing the parcel guard with expandable mesh basket receptacle.

Referring now to FIG. 7, is an exploded view of one preferred embodiment displaying components and their relative position in regards to one another.

I claim:

1. A parcel guard with expandable mesh basket receptacle, comprising:

a base platform plate mountable on a flat plane and having two attached housings at its ends situated on opposite sides from each other;

a removable inner lever with two ends, one end slid inside one of said base platform plate housings and the opposite end securely latched via a latching mechanism to the second of said base platform plate housings;

an outer arm with two ends, one end hingedly connected to said one end of said inner lever and rotatably moveable in a horizontal direction and the opposite end having a locking mechanism to lock the outer arm to the base platform plate housing;

an expandable and collapsible mesh basket for receiving packages having a flexible contour connected alongside the length of a lower edge of said inner lever and alongside the length of a lower edge of the said outer arm.

2. The parcel guard with expandable mesh basket receptacle according to claim 1, wherein the latching mechanism has an unlatched mode wherein the inner lever is disengaged, free to move away from base platform plate and a latched mode wherein upon closing, the inner lever is securely engaged to the base platform plate by said latching mechanism.

3. The parcel guard with expandable mesh basket receptacle according to claim 2, further comprises a spring connected at one end to said inner lever and to a retractable guide cable at the opposite end, said guide cable moves over a pulley assembly attached to the inner lever to redirect a horizontal movement of the spring to a vertical movement and said cable being connected to the mesh basket.

4. The parcel guard with expandable mesh basket receptacle according to claim 1, further comprises a spring connected at one end to said inner lever and to a retractable guide cable at the opposite end, said guide cable moves over a pulley assembly attached to the inner lever to redirect a horizontal movement of the spring to a vertical movement and said cable being connected to the mesh basket.

5. The parcel guard with expandable mesh basket receptacle according to 1, wherein the locking mechanism permits the outer arm to be interconnected or disconnected from the base platform plate as the outer arm can be locked and unlocked via said locking mechanism from an exterior of the outer arm.

6. The parcel guard with expandable mesh basket receptacle according to claim 1, wherein the locking and unlocking of the locking mechanism is supported through at least one or a combination of operatively coupled operations performed by key locks, digital key pads, mechanical key pads, card readers, RF readers, bio scanners, WiFi applications, smartphone applications, electromechanical magnets, FOB system.

7. The parcel guard with expandable mesh basket receptacle according to claim 1, wherein the mesh basket being collapsible at a rest position in the absence of any delivered packages in an area under and in between the base platform plate and the outer arm lower edge.

8. The parcel guard with expandable mesh basket receptacle according to claim 1, wherein the mesh basked is composed of flexible woven wire mesh and chain links such that the basket is collapsible and expandable.

* * * * *